United States Patent [19]

Terzian

[11] Patent Number: 4,483,628

[45] Date of Patent: Nov. 20, 1984

[54] BALANCED CHRONOGRAPH DIGITAL TIME DISPLAY

[76] Inventor: Beri A. Terzian, 66 Hirst Rd., Briarcliff Manor, N.Y. 10510

[21] Appl. No.: 244,760

[22] Filed: Mar. 17, 1981

Related U.S. Application Data

[63] Continuation-in-part of Ser. No. 53,402, Jun. 29, 1979, Pat. No. 4,264,966, which is a continuation-in-part of Ser. No. 861,115, Dec. 16, 1977, abandoned.

[51] Int. Cl.[3] ..... G04C 19/00; G04B 19/24

[52] U.S. Cl. ..... 368/82; 368/29; 368/110; 368/239

[58] Field of Search ..... 368/82–84, 368/155–156, 223, 228, 239–242; 340/756

[56] References Cited

U.S. PATENT DOCUMENTS

| | | | |
|---|---|---|---|
| 3,576,099 | 4/1971 | Walton | 368/80 |
| 3,613,351 | 10/1971 | Walton | 368/80 |
| 3,701,249 | 10/1972 | Bergey et al. | 368/239 |
| 3,722,206 | 3/1973 | Bergey | 368/239 |
| 3,760,582 | 9/1973 | Thiess et al. | 368/239 |
| 3,760,584 | 9/1973 | Dargent | 368/242 |
| 3,827,043 | 7/1974 | Maezawa | 368/239 |
| 3,971,012 | 7/1976 | Morokawa et al. | 368/80 |
| 4,092,638 | 5/1978 | Ripley | 368/239 |

FOREIGN PATENT DOCUMENTS

| | | | |
|---|---|---|---|
| 1388127 | 3/1975 | United Kingdom | 368/239 |
| 1442630 | 7/1976 | United Kingdom | 368/239 |
| 1475413 | 6/1977 | United Kingdom | 368/239 |

*Primary Examiner*—Vit W. Miska

*Attorney, Agent, or Firm*—Eyre, Mann, Lucas & Just

[57] ABSTRACT

A digital display arrangement is provided for balanced general timekeeping having centrally-positioned hour digits and two sets of smaller, equal-sized minute digits flanking the hour digits for trailing and leading readout, with hockey stick-shaped display elements positioned below the minute digits and oriented to give graphic symbols of minutes increasing past the present hour and minutes decreasing toward the next hour, respectively. Means are provided for blanking the hour digits and simultaneously energizing a chronograph time display which, because of resulting large spaces uniquely seen only between the chronograph digits, presents substantial visual contrast from, and minimum potential for ambiguity or confusion with, the general timekeeping mode.

21 Claims, 6 Drawing Figures

BALANCED CHRONOGRAPH DIGITAL TIME DISPLAY

CROSS-REFERENCE TO RELATED APPLICATION

This application is a continuation-in-part of copending application Ser. No. 53,402, filed Jun. 29, 1979, U.S. Pat. No. 4,264,966, which is a continuation-in-part of application Ser. No. 861,115, filed Dec. 16, 1977 and now abandoned.

BACKGROUND OF THE INVENTION

1. Field of the Invention

This invention relates to the use of digital time displays for general and chronograph timekeeping. In the present application, "general timekeeping" refers to the general timekeeping needs and practices of ordinary individuals occupied with their usual activities on a day-to-day basis. "Chronograph time-keeping" refers to specialized time monitoring procedures such as stop watch, split time, lap time and count down sequences used in games, sporting events, etc.

2. Description of the Prior Art

Digital timepieces have grown in popularity and have been estimated recently to account for nearly one-quarter of world timepiece sales. It is believed that many consumers purchasing such products desire not only the usual general timekeeping function but also various other timing modes such as chronographs, alarms, multiple time zones, calendars, and so on. Digital timepieces, therefore, have grown in complexity to attract or satisfy this perceived consumer demand.

With increasing complexity several problems have arisen which have detracted from the utility and convenience of digital timepieces. One problem arises from the fact that all such timepieces known to the applicant which provide both general and chronograph timekeeping functions do so with little or no visual contrast between these respective modes. Invariably, the same digits and positions as used for general timekeeping are also displayed when performing the chronograph functions. This tends to create uncertainty or confusion in the user's understanding of what is being displayed.

Attempts have been made to avoid such problems by providing abbreviations, fractions or other symbols in areas bordering the digital display in order to designate the various time units being displayed during respective timing modes. Such representations, however, are usually permanently inscribed on solid surfaces surrounding the digital display and remain in view at all times regardless of which timing mode is in use, thereby adding only further clutter and confusion.

SUMMARY OF THE INVENTION

Copending application Ser. No. 53,402, filed Jun. 29, 1979, discloses balanced digital display systems and methods for use in general timekeeping. In general, minute digits trail a display of the present hour and increase in value during an initial portion, such as the first half, of the hour. Thereafter and before the commencement of the next hour, the hour digit advances to the next hour and minute digits decrease in value in a leading readout position for the remainder of the hour. An optional display of seconds cycles up and down between values 0 and 30 during the period of each minute. The disclosure of application Ser. No. 53,402 is incorporated herein by reference as background to the present invention which adapts a balanced display for use also as a chronograph, without the above-noted problems of the prior art.

More particularly, the present invention provides a balanced digital display having centrally positioned hour digits, with smaller, equal-sized minute digits flanking the hour digits for readout in trailing and leading positions during the first and second halves of each hour. The minute digits are underscored with display elements oriented to provide hockey stick-shaped lines which function as graphic symbols of minutes increasing past the present hour during the first half hour, and minutes decreasing toward the next hour during the second half hour.

Means are provided for switching the general timekeeping display to a chronograph display. Such switching blanks the large central hour digits and the hockey stick lines, and simultaneously energizes both sets of minute digits for use as chronograph digits. This switching causes the chronograph digits to be separated by large spaces which are uniquely seen only in the chronograph mode and which are in substantial contrast from the digit spacings seen in the general timekeeping mode. This provides a clear visual distinction between the two modes, so that a brief glance is sufficient for the viewer to understand which mode is on display without uncertainty or confusion.

Other features and advantages of the invention will be evident from the subsequent detailed description taken in connection with the drawings.

DESCRIPTION OF THE PREFERRED EMBODIMENTS

Figure 1:
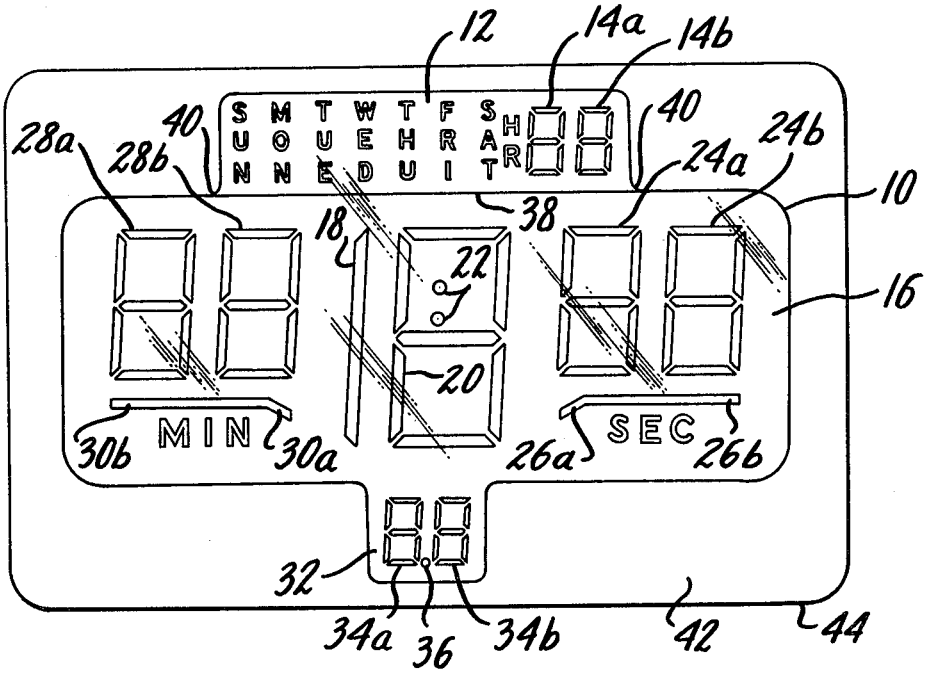
FIG. 1 is a front view of a preferred embodiment of digital display elements arranged for use in accordance with the invention.

Referring to FIG. 1, there is illustrated a display background 10 shaped into three visually distinct zones. There is a top zone 12 generally shaped as a horizontally-oriented rectangle of relatively narrow width and height. In it are contained vertically-aligned, three-letter abbreviations of the days of the week, arranged in "SUN" to "SAT" left-to-right order. These abbreviations, as well as all of the remaining elements shown in the entire background 10, are constituted of electrically energizable elements such as light emitting diodes, liquid crystals, or the like. Each set of the day abbreviations in zone 12 may be energized selectively to display each day of the week individually while the others remain blank.

To the right of "SAT" in zone 12 is a vertically-oriented "HR" abbreviation for hours. To the right of "HR" is a pair of conventional 7-element arrays of display elements 14*a*, 14*b*. Each such array may be selectively energized to display digits of values 0 to 9, so that the pair has the capability of displaying single or double digits up to a maximum of 99.

Below zone 12 is a middle zone 16, also generally rectangular in shape and horizontally oriented, but substantially wider and taller than zone 12. Centrally positioned in zone 16 is a vertical line element 18 and an adjacent 7-element array 20 which together may be selectively energized to display hour digits of values 1 to 12. Within array 20 are two vertically aligned dot-shaped elements 22 which may be energized simultaneously to display a colon.

To the right of array 20 is a pair of 7-element arrays 24*a*, 24*b*, of smaller overall size than array 20. The array pair 24*a*, 24*b* may be selectively energized to display increasing values of minutes in a readout position which trails the hour display 18, 20.

Below the array pair 24*a*, 24*b* is an energizable element 26 having a shape similar to a hockey stick, with a short segment 26*a* analogous to the blade portion and a longer segment 26*b* analogous to the handle portion. Below the hockey stick element 26 is the abbreviation "SEC" for seconds, centered in relation to the bottom width of the array pair 24*a*, 24*b*.

To the left of the hour digit elements 18, 20 is another pair of 7-element arrays 28*a*, 28*b*, equal in overall size to the array pair 24*a*, 24*b*. The array pair 28*a*, 28*b*, may be selectively energized to display decreasing values of minutes in a readout position which leads the hour display 18, 20.

Below array pair 28*a*, 28*b* is another hockey stick-shaped element 30, identical to element 26 but oriented in a reverse position. Specifically element 26, viewing it from left to right, has its short segment 26*a* sloping up and away from the hour display 18, 20 and then continuing into its longer horizontal segment 26*b*. Conversely, element 30 first shows its long horizontal segment 30*b* extending from left to right and then continuing into its short segment 30*a* which slopes down and toward the hour display 18, 20. Below the hockey stick element 30 is the abbreviation "MIN" for minutes, again centered in relation to the bottom width of the array pair 28*a*, 28*b*.

Below zone 16 is a generally square-shaped zone 32 which is substantially smaller in size than zones 12 and 16, and which is centered in relation to the bottom width of the hour display 18, 20. Zone 32 contains a pair of 7-element arrays 34*a*, 34*b* which are of smallest overall size compared to the other similar arrays 20, 24*a*, 24*b*, and 28*a*, 28*b*. The array pair 34*a*, 34*b* may be selectively energized to display values of seconds ranging between 0 and 30. A dot-shaped element 36 is included between arrays 34*a*, 34*b* and may be energized to display a decimal point before all digits displayed by array 34*b*.

Background 10 is defined by the perimeter line enclosing the above-described zones 12, 16 and 32. In addition to the distinctions in size and shape between these respective zones, zone 12 is preferably further separated from zone 16 by a horizontal line 38 which extends between the junctions 40 of these zones. The remaining surrounding area 42 and the outermost border line 44 are representative, for example, of the solid surface of a digital timepiece within which the display background 10 and its elements are located.

Figure 2:
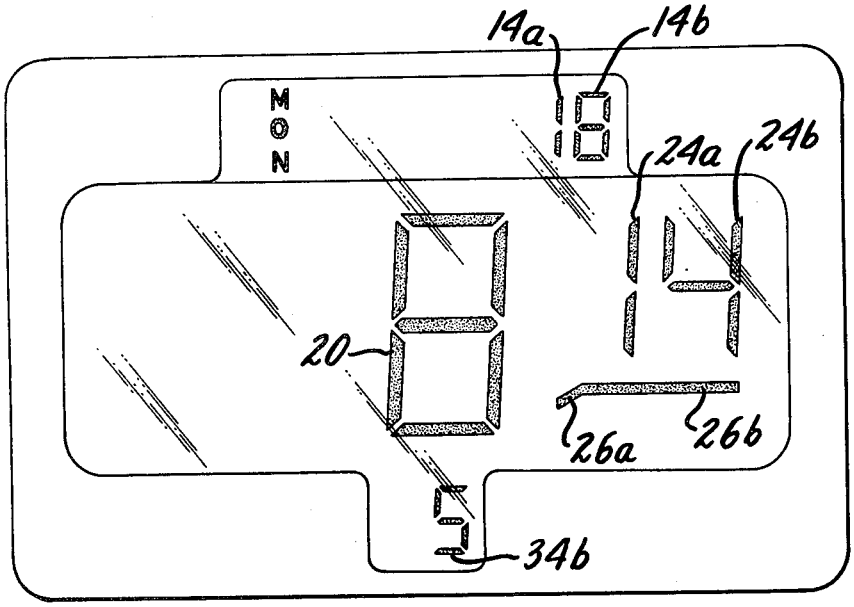
FIG. 2 is a similar view showing the FIG. 1 embodiment in a representative first half hour display of general timekeeping.

Referring to FIG. 2, there is illustrated energization of FIG. 1 in a representative first half hour display of balanced general timekeeping. As described in the copending application Ser. No. 53,402, minutes are increasing from 00 to 30 during the first half hour in a trailing readout position relative to the displayed present hour, and seconds are cycling up and down between 0 and 30 during each minute. Therefore, the specific time displayed in FIG. 2 is fourteen minutes past the eighth hour, with five seconds of that minute either having elapsed or remaining depending on whether seconds are progressing up or down.

The fact that the FIG. 2 display is in the first half hour of balanced general timekeeping is uniquely symbolized by the orientation of the hockey stick element 26 which is seen only during such periods. This element provides graphic confirmation to the viewer that minutes are then progressing up, out of and away from the displayed hour and, therefore, that the hour is in its expansion stage, in the sense that more of it is to be experienced than has passed.

Figure 3:
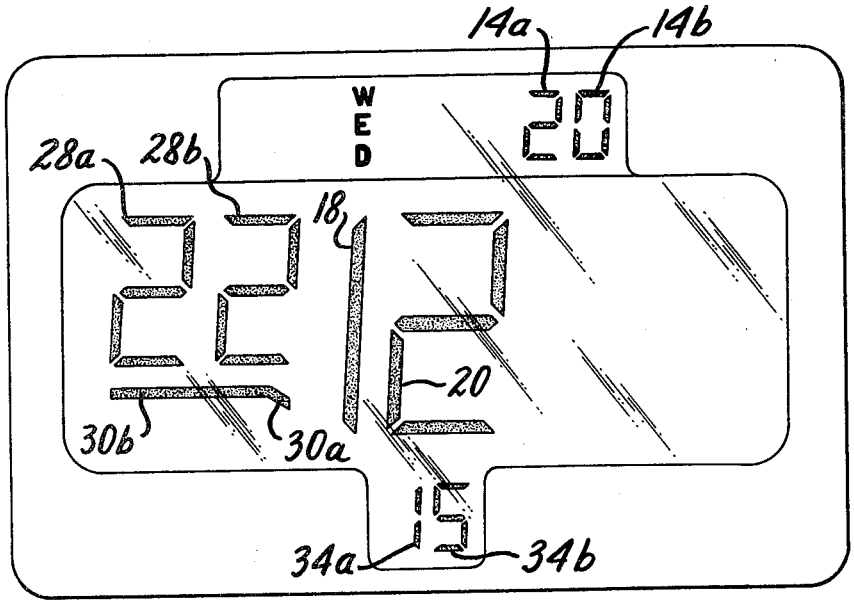
FIG. 3 is a similar view showing the FIG. 1 embodiment in a representative second half hour display of general timekeeping.

Referring now to FIG. 3, there is illustrated (two days after the display of FIG. 2) energization of FIG. 1 in a representative second half hour of balanced general timekeeping. Here the specific time is twenty-two minutes before the twelfth hour, with fifteen seconds of that minute having elapsed or remaining depending on the up or down progression of seconds.

Here the reverse orientation of the hockey stick element 30, compared to element 26, uniquely symbolizes the converse of the FIG. 2 type display, viz. that FIG. 3 is displaying specific times during second half hour periods. Element 30 provides a graphic indication confirming that minutes are then moving down, into and toward the approaching next hour and, therefore, that the present hour is in its contraction stage, in the sense that more of it has passed than remains.

It is also important to note that the displays of FIGS. 2 and 3 are entirely free of any extraneous or redundant information. Each day of the week is individually displayed separately from the others, so that the daily progress of each weekly period is graphically portrayed, together with a display of the date by elements 14*a*, 14*b*, in the top zone 12. The hockey stick elements 26 and 30 are uniquely seen only during successive first and second halves of each hour period. These factors, together with the triple zoning of the background and the visual guidance given by the size and shape of each zone to the information uniquely presented in it, result in complete freedom from clutter or confusion as to what is meant by the various displayed digits.

Figure 4:
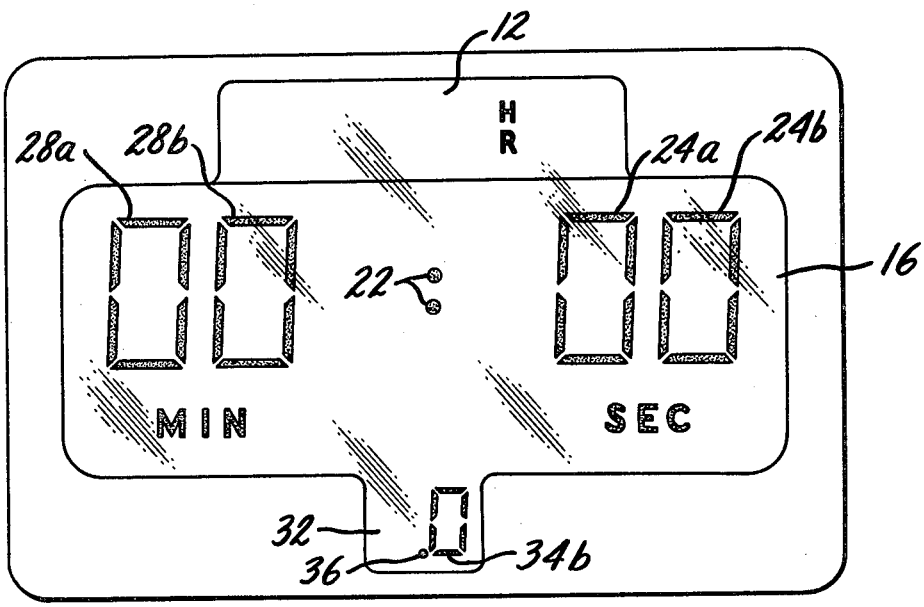
FIG. 4 is a similar view showing the FIG. 1 embodiment switched to a chronograph display at zero starting time.

Referring to FIG. 4, there is illustrated a switching of the FIG. 1 display to a chronograph display by selective blanking and energization of the display elements in background 10. Specifically, the hour elements 18, 20 are blanked and in the resulting space appears the colon 22. The hockey stick elements 30 and 26 are blanked and below the resulting spaces appear the "MIN", "SEC" abbreviations, respectively. The day/date displays in top zone 12 are blanked and in the resulting space appears the "HR" abbreviation. The array 34*a* is blanked and in the resulting space appears the decimal point 36. The arrays 28*a*, 28*b*, 24*a*, 24*b* and 34*b* are all set to zero.

Thus, the FIG. 1 display is converted to perform chronograph timing functions as previously described.

Figure 5:
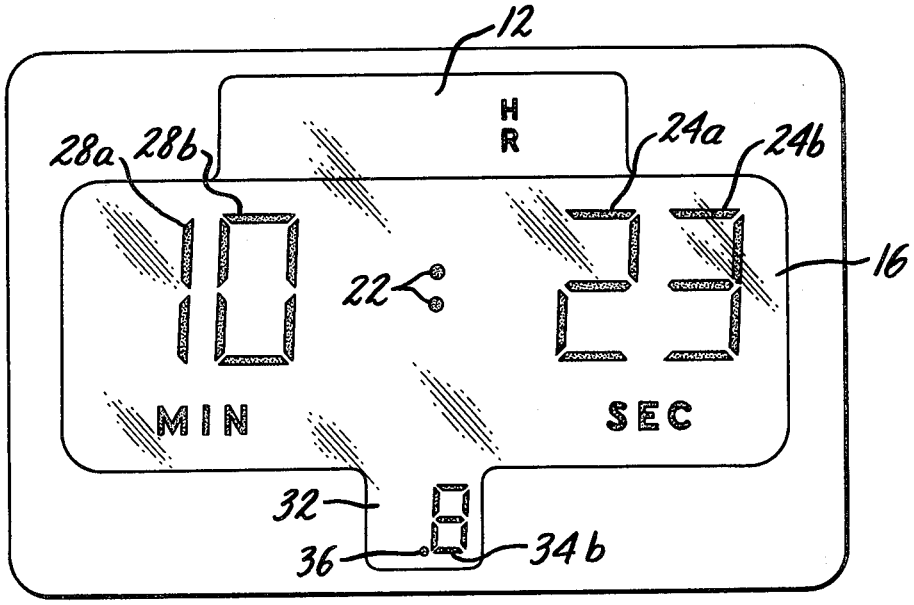
FIG. 5 is a view similar to FIG. 4 showing the chronograph display at 10:23.8 elapsed time.

For example, a representative stop watch function is displayed in FIG. 5 where an elapsed time of ten minutes and twenty-three and eight-tenth seconds is recorded. Preferably no zero digits are displayed to the right of "HR" in zone 12 at the starting time of FIG. 4, since most chronographically-timed events are completed in less than an hour and a zero digit, therefore, would be extraneous and an unnecessary distraction. On the other hand, many conventional digital chronographs are now capable of timing and storing in memory substantial time periods of many hours' length, and the chronograph displays of FIGS. 4 and 5 can be used to display elapsed times of up to a maximum of 99 hours by energization of the arrays 14*a*, 14*b* adjacent to the "HR" abbreviation in zone 12.

Comparison of the displays of FIGS. 4 and 5 to those of FIGS. 2 and 3 demonstrates an important advantage of the present invention in achieving chronograph displays which have substantial visual contrast from the appearance of the general timekeeping displays. Several factors are responsible for this improvement.

First, and most important, the large central area occupied by the hour digits 18, 20, when blanked, provides wide spacings and separations in zones 16 and 32 between the positions of all of the chronograph digits (minutes, seconds and tenth seconds), which are seen only during this mode. In contrast, the hour, minute and seconds digits, during the general timekeeping displays of FIGS. 2 and 3, are spaced much more closely together, in clusters occupying either the entire right or left portion of the same zones.

Also, the widely-spaced chronograph digits show symmetries of appearance arising from the equal-sized minute and second digits 28*a*, 28*b* and 24*a*, 24*b* being located at the opposite ends of zone 16, in horizontal balance with each other and in triangular balance with the tenth second digits 34*b* in the bottom zone 32. Such appearances again are unique to the chronograph display and further contribute to its substantial visual contrast from the general timekeeping displays. The blanking of the day-date information in zone 12 and the appearance of the "HR" abbreviation alone, in a position most to the right of that zone, are additional factors which are not seen during general timekeeping and which further contribute to the visual contrast.

Figure 6:
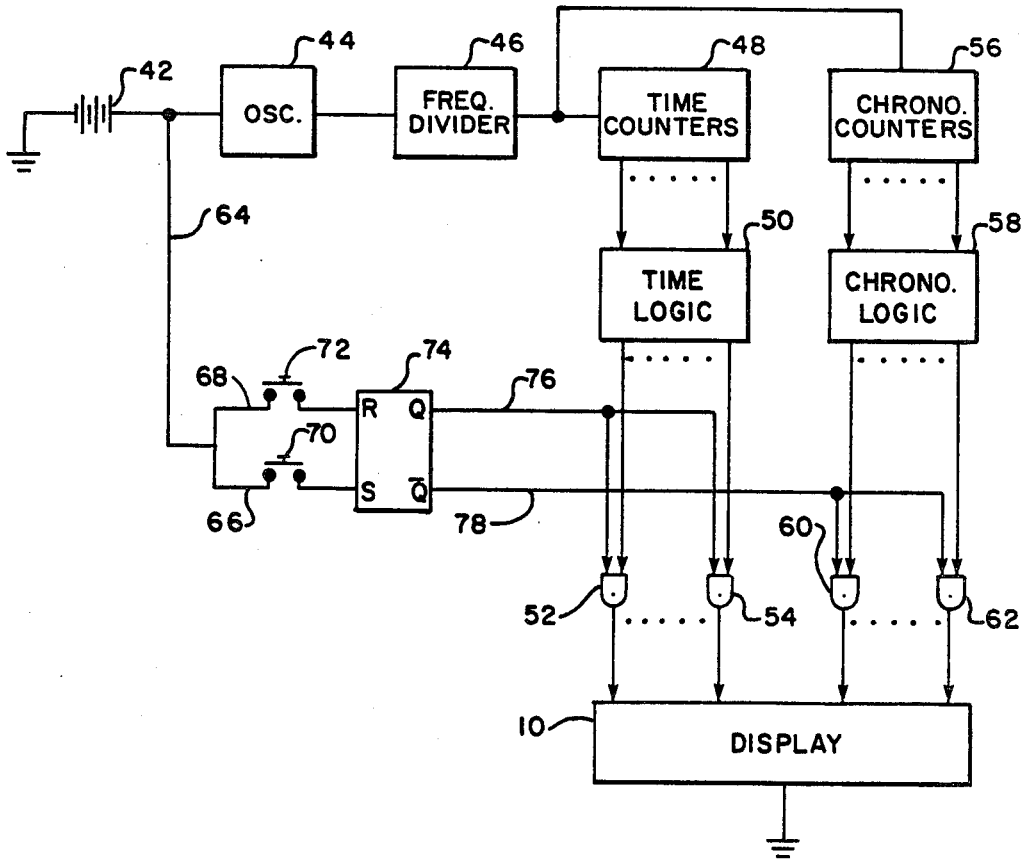
FIG. 6 is a block diagram of a circuit that may be used to operate the FIG. 1 display in the manner of the invention.

Accordingly, unlike conventional displays, the same digit positions and appearances are not presented during both general and chronograph timekeeping but rather substantial and easily seen differences are displayed as the user switches from one mode (FIGS. 2, 3) to the other (FIGS. 4, 5). Combined with the unique appearance of the "MIN", "SEC", colon and decimal point included in the chronograph mode, these differences unambiguously distinguish the two modes so that the user will be free from doubt or confusion when switching from one to the other Referring now to FIG. 6, there is illustrated a block diagram of a circuit which may be used to operate the FIG. 1 display in the manner described in connection with FIGS. 2–5. The circuit includes a power source such as battery 42 which is connected to an oscillator 44. As disclosed in application Ser. No. 53,402, this may be a solid state high frequency oscillator operating at 32,768 HZ to provide a high-accuracy, base time signal as its output which is transmitted to a multistage frequency divider 46.

Frequency divider 46 outputs a one HZ signal which is transmitted to up-down counters 48. The counters 48 and the time logic circuits 50 may be of the type described in application Ser. No. 53,402 to provide balanced general timekeeping signals through AND gates 52 and 54 to the display elements within background 10 of FIG. 1. It will be understood that such signals are provided through a multiplicity of lines and gates, symbolized by the four dots between the lines and gates connecting the counters 48 and logic 50 to the display in FIG. 6, and of sufficient number to energize the elements in the sequences required for balanced general timekeeping, as described in the cited patent application. The only difference is the provision of additional energizing signals to the hockey stick elements 26 and 30 of FIG. 1 during the successive first and second half hour periods.

The output of frequency divider 46 is also transmitted in parallel to counters 56 which may be of conventional type for accumulating hours, minutes, seconds and tenths of seconds, such counter outputs being transmitted to conventional decoder-driver circuits, symbolized by chrono logic 58, for translation into selective energization signals which, when passed through AND gates 60 and 62, will operate the display elements in background 10 in chronograph timing functions, as exemplified in FIGS. 4 and 5. Since the circuits and logic for operating 7-element arrays in various chronograph timing functions or sequences are conventional and well known, and since they are not original subject matter in the present invention, they have not been illustrated in detail.

Source voltage is connected by lines 64, 66 and 68 to push button switches 70 and 72. Operation of switch 70 sets flip-flop 74 so that its Q output is high and its $\overline{Q}$ output is at reference potential. As a result, line 76 is energized, gates 52 and 54 are enabled, and the general timekeeping signals from logic 50 are transmitted to the FIG. 1 display elements within background 10.

Alternatively, when push button switch 72 is operated, flip-flop 74 is reset, its $\overline{Q}$ output becomes high and its Q output goes to reference potential. As a result, gates 52 and 54 are disabled, gates 60 and 62 are enabled by input from line 78 and the FIG. 1 display is switched to the chronograph mode by disconnection of the general timekeeping signals and transmission of the chronograph signals from logic 58 to the display elements in background 10. Thus, the user is provided with the means for choosing between the two types of displays.

The invention has now been described in terms of its fundamental principles and a preferred illustrative embodiment. It will be evident to those skilled in the art that it may be implemented with various modifications without departing from its principles. For example, the change between trailing minute displays past the present hour to leading minute displays until the next hour may be made at any selected time during the hour, rather than the maximum balance point of the first half hour, to accommodate special circumstances during general timekeeping. The display of seconds and the bottom zone 32 may be eliminated where that degree of precision is not required or desired. Similarly, the calendar display of zone 12 may be eliminated where simpler models showing time only are preferred.

During chronograph timing, hundredths of seconds may be displayed by positioning the decimal point 36 to the left of array 34*a* and energizing both arrays of the pair 34*a* and *b*. Other indicia than the colon 22, for example, a dash or arrows pointing upwardly or downwardly, may be displayed during the chronograph timing functions to symbolize the separation and distinction between the minute/second time units or that the chronograph is counting up or down.

Accordingly, it will be understood that the invention is not limited to the preferred illustrative embodiment but encompasses the subject matter delineated by the following claims and all equivalents thereof.

The following is claimed:

1. A balanced general timekeeping digital display which comprises:
(a) a display background;
(b) hour elements operable for display of present or next hour digits during the same hour at substantially a central position within the background;
(c) first minute elements operable for display of minute digits in a readout position which trails the hour digits from left to right;
(d) second minute elements operable for display of minute digits in a readout position which leads the hour digits from left to right;
(e) hockey stick-shaped elements positioned below the minute elements and operable to display hockey stick-shaped lines below the minute digits;
(f) the hockey stick-shaped line below the trailing minute digits being oriented from left to right to display its short segment sloping up and away from the hour digits followed by its longer segment; and
(g) the hockey stick-shaped line below the leading minute digits being oriented from left to right to display its longer segment followed by its short segment sloping down and toward the hour digits.

2. A display as in claim 1 in which the overall sizes of the minute digits are equal, and are smaller than the overall size of the hour digits.

3. A display as in claim 1 in which the background comprises at least two zones which differ in size and shape, a first one of the zones being generally rectangular, horizontally oriented and containing the hour, minute and hockey stick-shaped elements, a second one of the zones being generally square shaped, substantially smaller in size than the first zone and located below the center of the first zone, the second zone containing seconds elements operable for display of seconds digits.

4. A display as in claim 3 in which the overall sizes of the digits differ in the order of the hour digits being the largest, the minute digits smaller, and the seconds digits the smallest.

5. A display as in claim 3 operable to display initially a present hour digit and trailing minute digits increasing from zero to thirty during the first half of such hour, and thereafter the next hour digit and leading minute digits decreasing from twenty-nine back toward zero during the second half of the same hour, and with the seconds digits progressing up and down between zero and thirty during each minute.

6. A display as in claim 3 in which the background includes a third zone above the first zone, the third zone being generally rectangular, horizontally oriented and narrower in width and height than the first zone, the third zone containing elements operable to display abbreviated names of the days of the week and the date.

7. A display as in claim 6 in which the abbreviations comprise the first three letters of each day, with each set of letters being in vertical alignment and placed in SUN-to-SAT left-to-right horizontal order followed by the date in the third zone, and being operable to display each day separately while the other days remain blank.

8. A display as in claim 7 which includes a horizontal line separating the third zone from the first zone.

9. A balanced general timekeeping and chronograph timekeeping digital display which comprises:
(a) a display background;
(b) hour elements operable for display of hour digits at substantially a central position within the background during general timekeeping;
(c) first minute elements operable for display of minute digits in a readout position which trails the hour digits from left to right during general timekeeping;
(d) second minute elements operable for display of minute digits in a readout position which leads the hour digits from left to right during general timekeeping; and
(e) means for blanking the hour digits and energizing both the leading and trailing minute digits for display of minutes and seconds, respectively, during chronograph timekeeping.

10. A display as in claim 9 in which the overall sizes of the minute digits are equal, and are smaller than the overall size of the hour digits.

11. A display as in claim 9 which includes elements operable for display of a colon at substantially a central position between the first and second minute digits, and elements operable for display of MIN and SEC abbreviations below the second and first minute digits, respectively, during chronograph timekeeping.

12. A display as in claim 11 in which the colon is displayed at a location within the space of the blanked hour digits.

13. A display as in claim 11 which includes hockey stick-shaped elements positioned below the first and second minute digits and above the MIN, SEC abbreviations and operable for display of hockey stick-shaped lines during general timekeeping, the hockey stick-shaped line below the first minute digits being oriented from left to right to display its short segment sloping up and away from the hour digits followed by its longer segment, and the hockey stick-shaped line below the second minute digits being oriented from left to right to display its longer segment followed by its short segment sloping down and toward the hour digits.

14. A display as in claim 11 in which the background comprises at least two zones which differ in size and shape, a first one of the zones being generally rectangular, horizontally oriented and containing the hour and minute elements, a second one of the zones being generally square shaped and substantially smaller in size than the first zone, the second zone containing at least one 7-element array of display elements and a dot display element operable for display of a decimal point and one-tenth second digits during chronograph timekeeping.

15. A display as in claim 14 in which the second zone contains a pair of 7-element arrays of display elements with the dot display element positioned between the arrays, the pair being operable for display of seconds digits progressing up and down between zero and thirty during each minute of general timekeeping.

16. A display as in claims 14 or 15 in which the overall sizes of the digits differ in the order of the hour digits being the largest, the minute digits smaller and the at least one of 7-element arrays the smallest.

17. A display as in claim 14 in which the background includes a third zone above the first zone, the third zone being generally rectangular, horizontally oriented and narrower in width and height than the first zone, the third zone containing elements operable for display of the abbreviation HR and at least one 7-element array of display elements operable for display of hour digits of values 0 to 9 during chronograph timekeeping.

18. A display as in claim 17 in which the third zone contains a pair of 7-element arrays for display of hour digits of values up to 99 during chronograph timekeeping.

19. A display as in claim 18 in which the third zone contains elements operable to display abbreviated names of the days of the week during general timekeeping, the abbreviations being operable to display each day separately while the other days remain blank.

20. A display as in claim 19 in which the day abbreviations comprise the first three letters of each day, each set of letters being vertically aligned and placed in SUN-to-SAT left-to-right horizontal order followed by the abbreviation HR and the pair of 7-element arrays, the arrays being operable to display the date of each day.

21. A display as in claim 20 which includes a horizontal line separating the third zone from the first zone.

* * * * *